US005717177A

United States Patent [19]

Tsai et al.

[11] Patent Number: 5,717,177

[45] Date of Patent: Feb. 10, 1998

[54] COMMON CONDUCTING UNIT FOR A CONTACT SWITCH

[75] Inventors: Chin-Shan Tsai; Tsui-Jong Su, both of Taipei Hsien, Taiwan

[73] Assignee: Shin Jiuh Corp., Taiwan

[21] Appl. No.: 761,198

[22] Filed: Dec. 6, 1996

[51] Int. Cl.[6] ..... H01H 5/18

[52] U.S. Cl. ..... 200/16 R; 200/461

[58] Field of Search ..... 200/16 R, 16 A, 200/16 B, 16 C, 16 D, 402, 405, 407, 408, 440, 445, 446, 449, 451, 453, 459, 460, 461, 468

[56] References Cited

U.S. PATENT DOCUMENTS

| | | | |
|---|---|---|---|
| 2,487,374 | 11/1949 | Riche et al. | 200/67 |
| 2,594,216 | 4/1952 | Roeser | 200/67 |
| 4,209,677 | 6/1980 | Brown | 200/67 D |
| 4,983,794 | 1/1991 | Kokubu | 200/461 |
| 5,089,715 | 2/1992 | Kokubu | 307/10.1 |
| 5,111,010 | 5/1992 | Kokubu et al. | 200/461 |
| 5,459,295 | 10/1995 | Ohta et al. | 200/461 |

*Primary Examiner*—Michael L. Gellner
*Assistant Examiner*—Michael A. Friedhofer
*Attorney, Agent, or Firm*—Fish & Richardson P.C.

[57] ABSTRACT

A common conductor unit for a contact switch includes a conductor body and a movable contact arm. The conductor body includes a U-shaped mounting unit that has upright first and second arm mounting portions and an elongated horizontal connecting portion which interconnects lower end edges of the arm mounting portions. Each of the arm mounting portions has one side which is opposite to the other one of the arm mounting portions and which is formed with a respective horizontal retaining groove. The contact arm is formed as an elongated plate and has a first end portion and a second end portion which is provided with a spring extension unit that extends toward the first end portion. One of the mounting unit and the contact arm is formed with a longitudinal opening to permit extension of the other one of the mounting unit and the contact arm when the contact arm is moved upwardly relative to the conductor body. The first end portion of the contact arm engages the retaining groove on the first arm mounting portion. The spring extension unit engages the retaining groove on the second arm mounting portion and biases the contact arm upwardly. The upper end edge of the second arm mounting portion is formed with a retaining unit to limit upward movement of the contact arm.

5 Claims, 6 Drawing Sheets

COMMON CONDUCTING UNIT FOR A CONTACT SWITCH

BACKGROUND OF THE INVENTION

1. Field of the Invention

The invention relates to a contact switch, more particularly to a common conducting unit of a contact switch.

2. Description of the Related Art

Referring to FIGS. 1 and 2, a conventional contact switch, such as a microswitch, is shown to comprise a casing 11, a common conducting unit including a conductor body 12 and a movable contact arm 13 mounted on the conductor body 12, a button member 14, and first and second conductors 15, 16. Each of the common conducting unit and the first and second conductors 15, 16 is disposed in the casing 11. Each of the conductor body 12 and the first and second conductors 15, 16 has a leg portion that extends out of the casing 11. The button member 14 is disposed in the casing 11 on top of the movable contact arm 13, and is operable so as to move the contact arm 13 from a first position where the contact arm 13 connects the conductor body 12 and the first conductor 15, and a second position where the contact arm 13 connects the conductor body 12 and the second conductor 16.

The conductor body 12 has a horizontal plate portion 121 with parallel first and second end edges, a leg portion 122 extending integrally and downwardly from the first end edge of the plate portion 121, and first and second arm mounting portions 123, 124 extending integrally and upwardly from a respective one of the first and second end edges of the plate portion 121. Each of the first and second arm mounting portions 123, 124 has one side which is opposite to the other one of the arm mounting portions 123, 124 and which is formed with a respective horizontal retaining groove 1230, 1240. The retaining groove 1230 on the first arm mounting portion 123 is disposed higher than the retaining groove 1240 on the second arm mounting portion 124 relative to the plate portion 121.

The movable contact arm 13 is formed as an elongated plate and is formed with a longitudinal opening 130 which has parallel first and second end edges. The movable contact arm 13 has a spring plate 132 which extends in the longitudinal opening 130 from the second end edge of the longitudinal opening 130 to the first end edge of the latter. The movable contact arm 13 is further provided with a contact stub 131 adjacent to the second end edge of the longitudinal opening 130.

When the movable contact arm 13 is mounted on the conductor body 12, the first and second arm mounting portions 123, 124 of the conductor body 12 extend through the longitudinal opening 130 in the movable contact arm 13 such that the first end edge of the longitudinal opening 130 engages the retaining groove 1230 on the first arm mounting portion 123 while a distal end of the spring plate 132 engages the retaining groove 1240 on the second arm mounting portion 124. At this time, the spring plate 132 is bent so as to bias the contact stub 131 to the first position, where the contact arm 13 connects the conductor body 12 and the first conductor 15, when the common conducting unit is installed in the casing 11.

During assembly, the first and second conductors 15, 16 are first secured to the casing 11. Due to space restrictions, the common conducting unit is assembled before being secured to the casing 11. Finally, the button member 14 is mounted to the casing 11 to complete assembly of the contact switch.

The drawback of the conventional common conducting unit is as follows: Downward movement of the movable contact arm 13 relative to the conductor body 12 is required when mounting the former onto the latter. Bending of the spring plate 132 during the mounting of the movable contact arm 13 onto the conductor body 12 results in a counteracting upward force. It is difficult to assemble the common conducting unit manually since the conductor body 12 lacks a structure for limiting upward movement and preventing eventual removal of the movable contact arm 13 due to the upward biasing force that is generated. Therefore, the conventional common conducting unit is usually assembled in a fully automated manner. The fully automated machine for assembling the conventional common conducting unit has a relatively complicated and expensive structure in view of the need to resist the counteracting upward force while clamping the conductor body 12 and the movable contact arm 13 at the same time.

SUMMARY OF THE INVENTION

The main object of the present invention is to provide a common conducting unit which is to be used in a contact switch and which can be assembled manually or automatically in a less complicated manner.

Accordingly, the common conductor unit of the present invention comprises:

a conductor body including a U-shaped mounting unit that has upright first and second arm mounting portions with upper and lower end edges and an elongated horizontal connecting portion which interconnects the lower end edges of the first and second arm mounting portions, each of the first and second arm mounting portions having one side which is opposite to the other one of the first and second arm mounting portions and which is formed with a respective horizontal retaining groove, the retaining groove on the first arm mounting portion being disposed higher than the retaining groove on the second arm mounting portion relative to the connecting portion; and a movable contact arm formed as an elongated plate and having a first end portion and a second end portion which is provided with a spring extension unit that extends toward the first end portion;

one of the mounting unit of the conductor body and the movable contact arm being formed with a longitudinal opening to permit extension of the other one of the mounting unit and the movable contact arm when the movable contact arm is moved upwardly relative to the conductor body, the first end portion of the movable contact arm engaging the retaining groove on the first arm mounting portion, the spring extension unit having a distal end that engages the retaining groove on the second arm mounting portion, the spring extension unit being bent so as to bias the movable contact arm upwardly, the upper end edge of the second arm mounting portion being formed with a retaining unit that limits upward movement and that prevents removal of the movable contact arm from the conductor body due to upward biasing force of the spring extension unit.

In one embodiment of the present invention, the mounting unit is formed with the longitudinal opening which extends continuously from the upper end edge to the lower end edge of the first arm mounting portion, through the connecting portion, and from the lower end edge of the second arm mounting portion to near the upper end edge of the second arm mounting portion. The retaining unit is inverted U-shaped, and the first end portion of the movable contact arm is wider than the longitudinal opening.

In another embodiment of the present invention, the movable contact arm is formed with the longitudinal opening which has parallel first and second end edges. The first end portion of the movable contact arm defines the first end edge of the longitudinal opening. The spring extension unit includes a spring plate which extends in the longitudinal opening from the second end edge of the longitudinal opening to the first end edge of the longitudinal opening. The retaining unit on the upper end edge of the second arm mounting portion is transverse to the movable contact arm.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
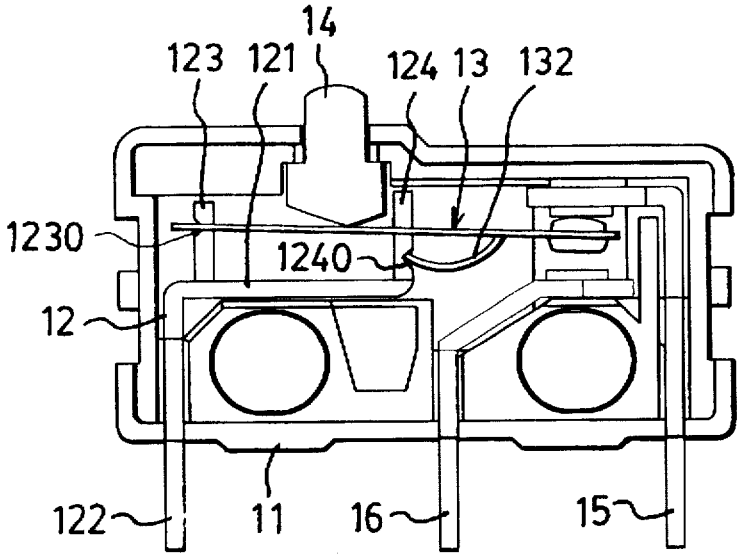
FIG. 1 PRIOR ART
FIG. 1 illustrates a contact switch with a conventional common conducting unit.
Figure 2:
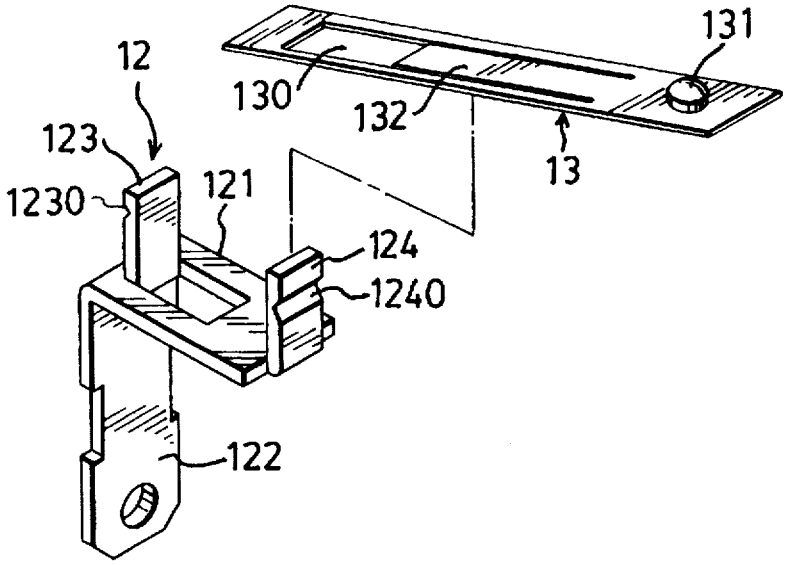
FIG. 2 PRIOR ART
FIG. 2 is an exploded perspective view of the conventional common conducting unit shown in FIG. 1.
Figure 3:
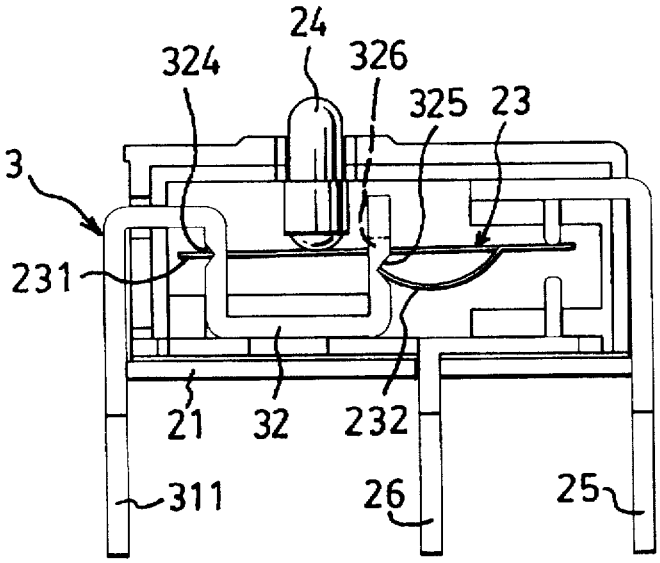
FIG. 3 illustrates a contact switch which incorporates the first preferred embodiment of a common conducting unit according to the present invention.
Figure 4:
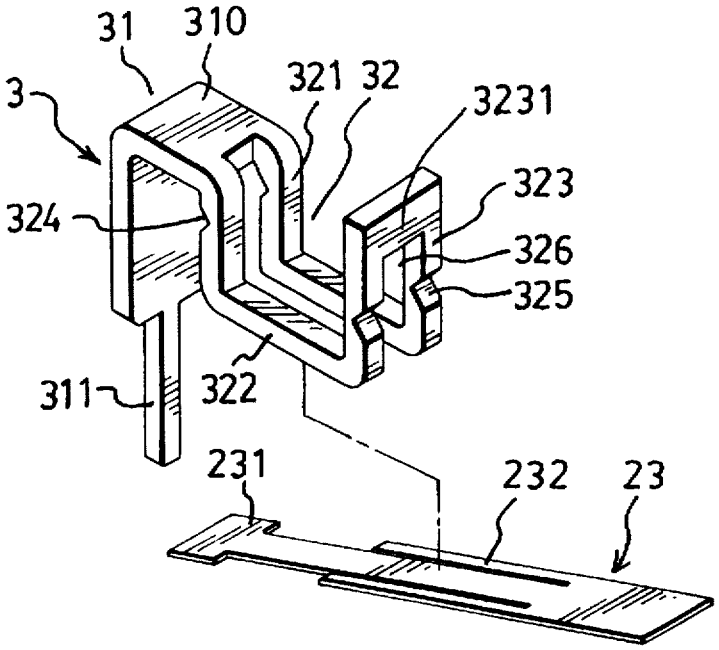
FIG. 4 is an exploded perspective view of the first preferred embodiment.

Referring to FIG. 3, the first preferred embodiment of a common conducting unit according to the present invention is shown to be incorporated in a contact switch which includes a casing 21, a button member 24, and first and second conductors 25, 26. The common conducting unit includes a conductor body 3 and a movable contact arm 23 mounted on the conductor body 3. Each of the common conducting unit and the first and second conductors 25, 26 is disposed in the casing 21. Each of the conductor body 3 and the first and second conductors 25, 26 has a leg portion that extends out of the casing 21. The button member 24 is disposed in the casing 21 on top of the movable contact arm 23, and is operable so as to move the contact arm 23 from a first position where the contact arm 23 connects the conductor body 3 and the first conductor 25, and a second position where the contact arm 23 connects the conductor body 3 and the second conductor 26.

The conductor body 3 includes a U-shaped mounting unit 32 having upright first and second arm mounting portions 321, 323 with upper and lower end edges and an elongated horizontal connecting portion 322 which interconnects the lower end edges of the first and second arm mounting portions 321, 323. Each of the first and second arm mounting portions 321, 323 has one side which is opposite to the other one of the arm mounting portions 321, 323 and which is formed with a respective horizontal retaining groove 324, 325. The retaining groove 324 on the first arm mounting portion 321 is disposed higher than the retaining groove 325 on the second arm mounting portion 323 relative to the connecting portion 322. The mounting unit 32 is formed with a longitudinal opening 326 which extends continuously from the upper end edge to the lower end edge of the first arm mounting portion 321, through the connecting portion 322, and from the lower end edge of the second arm mounting portion 323 to near the upper end edge of the latter, thereby forming an inverted U-shaped retaining unit 3231 on the upper end edge of the second arm mounting portion 323. The conductor body 3 further includes a leg portion 31 with a horizontal section 310 which extends integrally from the upper end edge of the first arm mounting portion 321 in a direction away from the second arm mounting portion 323, and a vertical section 311 which extends integrally and downwardly from the horizontal section 310. The vertical section 311 is parallel to the first arm mounting portion 321 and forms a clearance therewith.

The movable contact arm 23 is formed as an elongated plate and is extendible through the longitudinal opening 326 in the mounting unit 32 of the conductor body 3. The contact arm 23 has a first end portion 231 which is wider than the longitudinal opening 326, and a second end portion which is formed with a spring extension unit that extends toward the first end portion 231. In this embodiment, the spring extension unit includes a pair of spring plates 232 that are disposed on two longitudinal sides of the contact arm 23.

Figure 5:
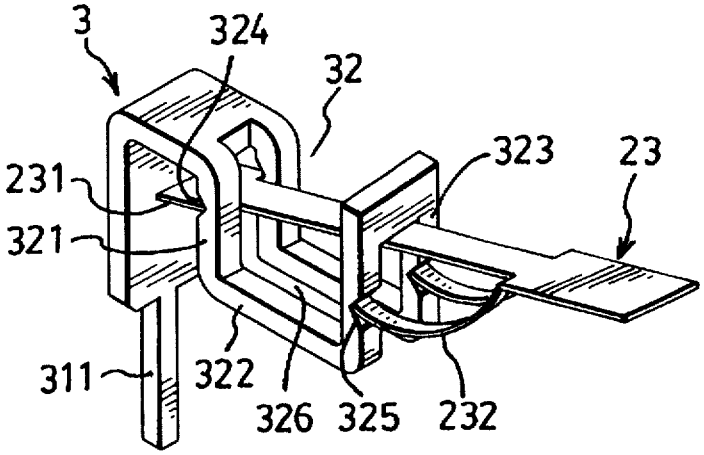
FIG. 5 is a perspective view of the first preferred embodiment to illustrates its assembly.

Referring to FIG. 5, when the movable contact arm 23 is mounted on the conductor body 3, the contact arm 23 is moved upward relative to the conductor body 3 so that the former extends into the longitudinal opening 326 in the mounting unit 32 of the latter. At this time, the first end portion 231 of the contact arm 23 is disposed in the clearance between the vertical section 311 and the first arm mounting portion 321, and engages the retaining groove 324 on the first arm mounting portion 321. The spring plates 232 have distal ends that engage the retaining groove 325 on the second arm mounting portion 323. Since the retaining groove 324 is disposed higher than the retaining groove 325, the spring plates 232 are bent so as to bias the contact arm 23 upwardly to the first position, where the contact arm 23 connects the conductor body 3 and the first conductor 25, when the common conducting unit is installed in the casing 21. The retaining unit 3231 on the upper end edge of the second arm mounting portion 323 limits upward movement and prevents removal of the movable contact arm 23 from the conductor body 3 due to the upward biasing force of the spring plates 232, thereby facilitating manual or automated assembly of the common conducting unit of this embodiment.

In this embodiment, the leg portion 31 of the conductor body 3 extends from the upper end edge of the first arm mounting portion 321. Alternatively, the leg portion may extend from the upper end edge of the second arm mounting portion 323 or downwardly from either of the longitudinal sides of the connecting portion 322 as long as the leg portion does not hinder upward movement of the contact arm 23 into the longitudinal opening 326 in the conductor body 3.

Figure 6:
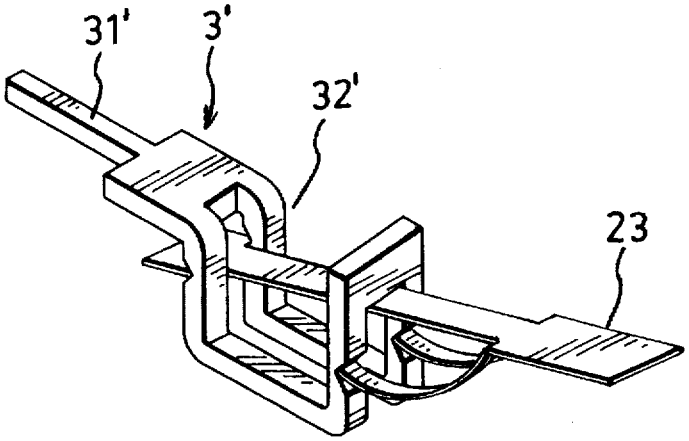
FIG. 6 is a perspective view of the second preferred embodiment of a common conducting unit according to the present invention.

FIG. 6 illustrates the second preferred embodiment of a common conducting unit according to the present invention. As shown, the second preferred embodiment is generally similar to the first preferred embodiment except for the leg portion 31' of the conductor body 3'. In this embodiment, the leg portion 31' extends horizontally from the mounting unit 32' and is not provided with a downwardly extending section.

Figure 7:
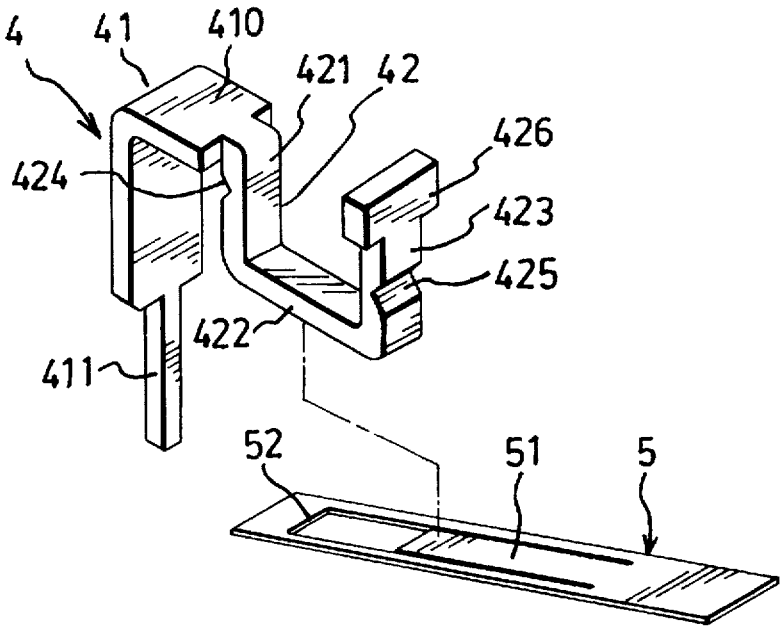
FIG. 7 is an exploded perspective view of the third preferred embodiment of a common conducting unit according to the present invention.

FIG. 7 illustrates the third preferred embodiment of a common conducting unit according to the present invention. As illustrated, the common conducting unit includes a conductor body 4 and a movable contact arm 5 to be mounted on the conductor body 4.

The conductor body 4 includes a U-shaped mounting unit 42 having upright first and second arm mounting portions 421, 423 with upper and lower end edges and an elongated horizontal connecting portion 422 which interconnects the lower end edges of the first and second arm mounting portions 421, 423. Each of the first and second arm mounting portions 421, 423 has one side which is opposite to the other one of the arm mounting portions 421, 423 and which is formed with a respective horizontal retaining groove 424, 425. The retaining groove 424 on the first arm mounting portion 421 is disposed higher than the retaining groove 425 on the second arm mounting portion 423 relative to the connecting portion 422. The upper end edge of the second arm mounting portion 423 is formed with a retaining unit 426. The conductor body 4 further includes a leg portion 41 with a horizontal section 410 which extends integrally from the upper end edge of the first arm mounting portion 421 in a direction away from the second arm mounting portion 423, and a vertical section 411 which extends integrally and downwardly from the horizontal section 410. The vertical section 411 is parallel to the first arm mounting portion 421 and forms a clearance therewith.

The movable contact arm 5 is formed as an elongated plate and is provided with a longitudinal opening 50 which has parallel first and second end edges. The first end edge of the longitudinal opening 50 is defined by a first end portion 52 of the movable contact arm 5. The movable contact arm 5 further has a second end portion which is provided with a spring extension unit that extends toward the first end portion 52. In this embodiment, the spring extension unit includes a spring plate 51 which extends in the longitudinal opening 50 from the second end edge of the longitudinal opening 50 to the first end edge of the same.

Figure 8:
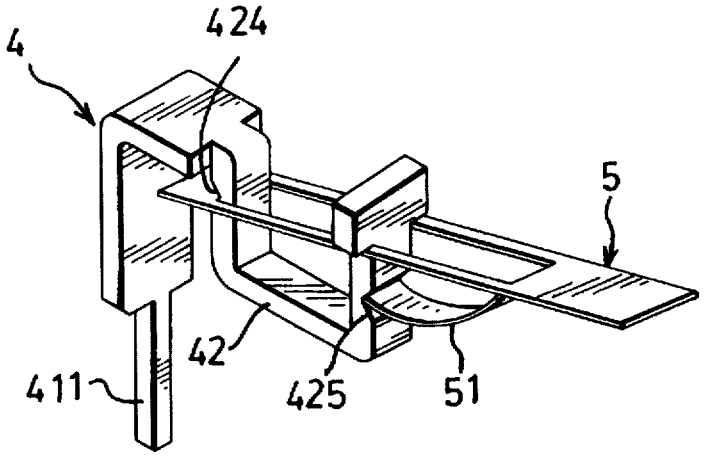
FIG. 8 is a perspective view of the third preferred embodiment to illustrates its assembly.

Referring to FIG. 8, when the movable contact arm 5 is mounted on the conductor body 4, the contact arm 5 is moved upward relative to the conductor body 4 so that the latter extends into the longitudinal opening 50 in the contact arm 5. At this time, the first end portion 52 of the contact arm 5 is disposed in the clearance between the vertical section 411 and the first arm mounting portion 421 of the conductor body 4, and engages the retaining groove 424 on the first arm mounting portion 421. The spring plate 51 has a distal end that engages the retaining groove 425 on the second arm mounting portion 423. Since the retaining groove 424 is disposed higher than the retaining groove 425, the spring plate 51 is bent so as to bias the contact arm 5 upwardly. The retaining unit 426 on the upper end edge of the second arm mounting portion 423 is transverse to the contact arm 5 and limits upward movement and prevents removal of the movable contact arm 5 from the conductor body 4 due to the upward biasing force of the spring plate 51, thereby facilitating manual or automated assembly of the common conducting unit of this embodiment.

Like the first preferred embodiment, the leg portion 41 of the conductor body 4 extends from the upper end edge of the first arm mounting portion 421. Alternatively, the leg portion may extend from the upper end edge of the second arm mounting portion 423 or downwardly from the connecting portion 422 as long as the leg portion does not hinder movement of the conductor body 4 into the longitudinal opening 50 in the contact arm 5.

Figure 9:
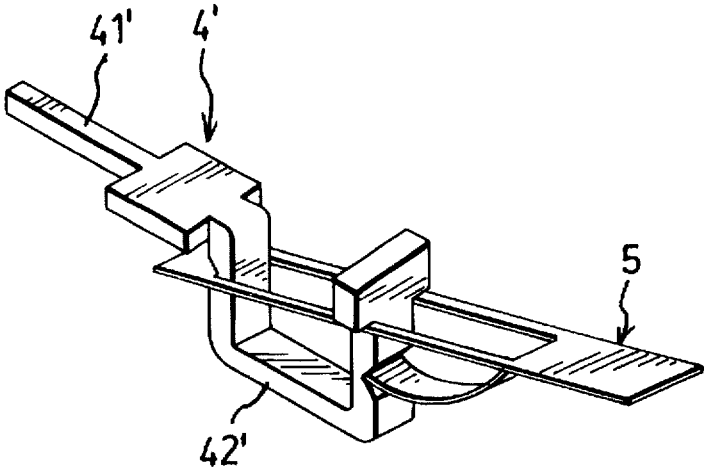
FIG. 9 is a perspective view of the fourth preferred embodiment of a common conducting unit according to the present invention.

FIG. 9 illustrates the fourth preferred embodiment of a common conducting unit according to the present invention. As shown, the fourth preferred embodiment is generally similar to the third preferred embodiment except for the leg portion 41' of the conductor body 4'. In this embodiment, the leg portion 41' extends horizontally from the mounting unit 42' and is not provided with a downwardly extending section.

It has thus been shown that the common conducting unit of this invention permits manual or automated assembly in a less complicated manner. The object of the invention is thus achieved.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. A common conductor unit for a contact switch, comprising:

a conductor body including a U-shaped mounting unit that has upright first and second arm mounting portions with upper and lower end edges and an elongated horizontal connecting portion which interconnects said lower end edges of said first and second arm mounting portions, each of said first and second arm mounting portions having one side which is opposite to the other one of said first and second arm mounting portions and which is formed with a respective horizontal retaining groove, said retaining groove on said first arm mounting portion being disposed higher than said retaining groove on said second arm mounting portion relative to said connecting portion; and a movable contact arm formed as an elongated plate and having a first end portion and a second end portion which is provided with a spring extension unit that extends toward said first end portion;

one of said mounting unit of said conductor body and said movable contact arm being formed with a longitudinal opening to permit extension of the other one of said mounting unit and said movable contact arm when said movable contact arm is moved upwardly relative to said conductor body, said first end portion of said movable contact arm engaging said retaining groove on said first arm mounting portion, said spring extension unit having a distal end that engages said retaining groove on said second arm mounting portion, said spring extension unit being bent so as to bias said movable contact arm upwardly, said upper end edge of said second arm mounting portion being formed with a retaining unit that limits upward movement and that prevents removal of said movable contact arm from said conductor body due to upward biasing force of said spring extension unit.

2. The common conductor unit for a contact switch as claimed in claim 1, wherein said mounting unit is formed with said longitudinal opening which extends continuously from said upper end edge to said lower end edge of said first arm mounting portion, through said connecting portion, and from said lower end edge of said second arm mounting portion to near said upper end edge of said second arm mounting portion, said retaining unit being inverted U-shaped, said first end portion of said movable contact arm being wider than said longitudinal opening.

3. The common conducting unit for a contact switch as claimed in claim 2, wherein said spring extension unit includes a pair of spring plates disposed on two longitudinal sides of said contact arm.

4. The common conducting unit for a contact switch as claimed in claim 1, wherein said movable contact arm is formed with said longitudinal opening which has parallel first and second end edges, said first end portion of said movable contact arm defining said first end edge of said longitudinal opening, said spring extension unit including a spring plate which extends in said longitudinal opening from said second end edge of said longitudinal opening to said first end edge of said longitudinal opening, said retaining unit on said upper end edge of said second arm mounting portion being transverse to said movable contact arm.

5. The common conducting unit for a contact switch as claimed in claim 1, wherein said conductor body further includes a leg portion with a horizontal section which extends integrally from said upper end edge of one of said first and second arm mounting portions in a direction away from the other one of said first and second arm mounting portions, and a vertical section which extends integrally and downwardly from said horizontal section, said vertical section being parallel to said one of said first and second arm mounting portions and forming a clearance therewith.

* * * * *